US008375912B2

(12) United States Patent
Lent

(10) Patent No.: US 8,375,912 B2
(45) Date of Patent: Feb. 19, 2013

(54) ENGINE CONTROL SYSTEM AND METHOD FOR STOPPING ENGINE AT DESIRED ENGINE STOPPING POSITION

(75) Inventor: Stanley D. Lent, Mars, OH (US)

(73) Assignee: Honda Motor Co., Ltd., Tokyo (JP)

( * ) Notice: Subject to any disclaimer, the term of this patent is extended or adjusted under 35 U.S.C. 154(b) by 427 days.

(21) Appl. No.: 12/764,228

(22) Filed: Apr. 21, 2010

(65) Prior Publication Data

US 2011/0264359 A1 Oct. 27, 2011

(51) Int. Cl.
*F02N 1/00* (2006.01)

(52) U.S. Cl. ..... 123/179.1; 123/491

(58) Field of Classification Search .... 123/179.1–179.5, 123/179.16, 179.28, 491
See application file for complete search history.

(56) References Cited

U.S. PATENT DOCUMENTS

| | | | | |
|---|---|---|---|---|
| 6,647,955 | B1 | 11/2003 | Sieber | |
| 6,807,476 | B2 | 10/2004 | Ando et al. | |
| 6,910,344 | B2 * | 6/2005 | Matsubara et al. | 62/228.3 |
| 7,027,911 | B2 | 4/2006 | Nishikawa et al. | |
| 7,066,127 | B2 | 6/2006 | Flanagan et al. | |
| 7,079,939 | B2 * | 7/2006 | Kataoka et al. | 701/112 |
| 7,114,484 | B2 | 10/2006 | Kaita et al. | |
| 7,177,755 | B2 | 2/2007 | Nishikawa et al. | |
| 7,204,222 | B2 | 4/2007 | Yamauchi et al. | |
| 7,228,209 | B2 | 6/2007 | Izawa et al. | |
| 7,263,959 | B2 * | 9/2007 | Kataoka et al. | 123/179.4 |
| 7,441,541 | B2 | 10/2008 | Nakamura et al. | |
| 2004/0149247 | A1 * | 8/2004 | Kataoka et al. | 123/179.4 |
| 2004/0159297 | A1 * | 8/2004 | Kataoka et al. | 123/179.4 |
| 2008/0127935 | A1 | 6/2008 | Park | |
| 2009/0050087 | A1 * | 2/2009 | Ezaki | 123/90.16 |

FOREIGN PATENT DOCUMENTS

| | | |
|---|---|---|
| JP | 2007270676 | 10/2007 |

* cited by examiner

*Primary Examiner* — John Kwon
(74) *Attorney, Agent, or Firm* — Rankin Hill & Clark LLP

(57) ABSTRACT

An engine control system and method includes an air conditioner compressor operatively connected to an engine for generating a counter torque to the engine and when actuated. An ECU is operatively connected to the compressor. The ECU actuates the compressor when the engine is turned off, engine speed of the engine is less than a predetermined engine speed, and an engine rotational position is within a predetermined range of top dead center for the engine.

20 Claims, 4 Drawing Sheets

ENGINE CONTROL SYSTEM AND METHOD FOR STOPPING ENGINE AT DESIRED ENGINE STOPPING POSITION

BACKGROUND

The present disclosure generally relates generally to an engine control system and method, and particularly relates to an engine control system and method for stopping an internal combustion engine at a desired engine stopping position.

If an internal combustion engine is stopped at an angular position in which there is valve overlap, exhaust gasses can potentially travel into the intake manifold. This can result in a lack of oxygen in the intake manifold which, upon a subsequent restart of the engine, can undesirably cause a prolonged engine start.

To address this problem, one known engine control system monitors an internal combustion engine to determine engine rotational position and to determine if provide engine speed is below a preset reference value before applying an engine stop and control. In this system, the engine stopping control is the application of a counterforce applied to the engine, the counterforce being an increased compression pressure seen by the engine through use of the air intake control. This results in a more rapid reduction of engine speed (i.e., the engine is braked) toward a desired stopping position.

SUMMARY

According to one aspect, an engine control system for stopping an internal combustion engine at a desired engine stopping position includes an air conditioner compressor operatively connected to the engine that generates a counter torque to the engine when actuated. The system also includes at least one device for indicating that the engine is off, an engine speed sensor for indicating an engine speed of the engine, and a rotational position sensor for indicating an engine rotational position. An ECU is operatively connected to the compressor, the at least one device, the engine speed sensor and the rotational position sensor. The ECU actuates the compressor to generate the counter torque to stop the engine at the desired engine stopping position when the at least one device indicates that the engine is off, the engine speed sensor indicates that the engine speed is less than a predetermined engine speed, and the rotational position sensor indicates that the engine rotational position is within predetermined limits of top dead center.

According to another aspect, an engine control method is provided for stopping an internal combustion engine at a desired engine stopping position. In the method according to this aspect, the internal combustion engine is determined to be off. An engine speed of the internal combustion engine is determined to be below a predetermined engine speed. An engine rotational position is determined to be within predetermined limits. An air conditioner compressor is turned on to stop the engine at the desired engine stopping position when determined that the engine is off, the engine speed is below the predetermined engine speed, and the engine rotational position is within the predetermined limits.

According to still another aspect, an engine control system includes an engine having a crankshaft pulley and an air conditioner compressor having a compressor pulley rotatably connected to the crankshaft pulley by a belt. An ECU is operatively connected to the compressor. The ECU actuates the compressor when the engine is turned off, engine speed of the engine is less than a predetermined engine speed, and the crankshaft pulley is within a predetermined range of top dead center for the engine.

DETAILED DESCRIPTION

Figure 1:
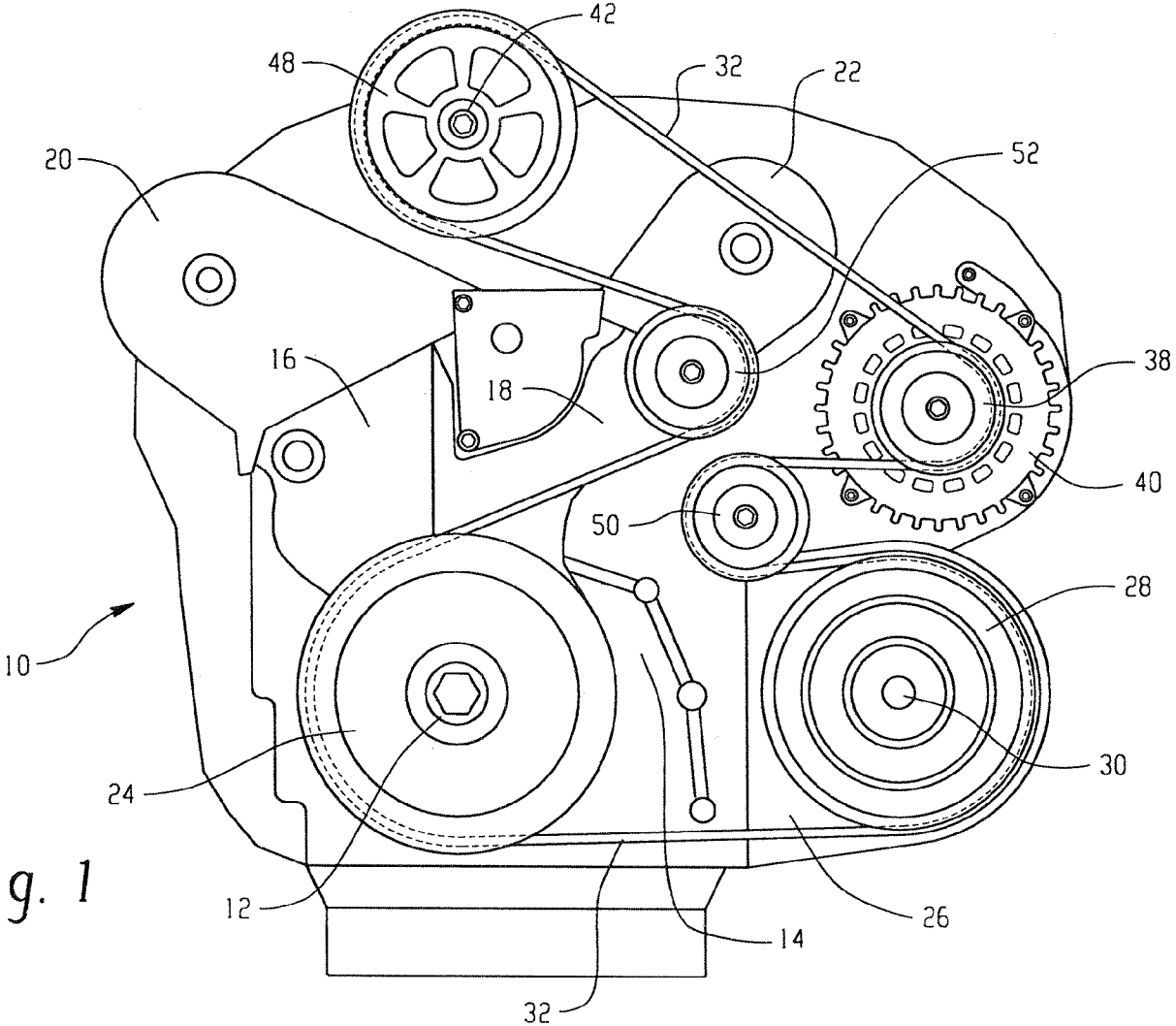
FIG. 1 is a side view of a V-type internal combustion engine having an a/c compressor rotatably connected to a crankshaft by a belt.

Referring now to the drawings, wherein the showings are only for purposes of illustrating one or more exemplary embodiments and not for purposes of limiting same, FIG. 1 illustrates an internal combustion engine 10 that can be mounted in a vehicle. The engine 10 which cam be a DOHC gasoline engine or some other type of engine, has a crankshaft 12 that is disposed in a direction parallel to a longitudinal direction of the vehicle body in which the engine 10 is to be mounted. The engine 10 includes an engine block 14 on which two banks of cylinders are arranged in line with respective cylinder heads 16, 18 coupled onto the engine block 14 and respective head covers 20, 22 coupled onto the cylinder blocks 16, 18. While illustrated as a V-type engine, it is to be understood and appreciated by those skilled in the art that the engine 10 could be some other type and can have some other configuration. Also, the engine 10 need not be limited to any particular number of cylinders.

The engine 10 of the illustrated embodiment has a crankshaft pulley 24 fixed to an outer end of the crankshaft 12. An air conditioner compressor 26 is operatively connected to the engine 10. As will be described in more detail below, the compressor 26 can generate a counter torque to the engine 10 when actuated for purposes of stopping the engine 10 at a desired engine stopping position. In particular, the compressor 26 can be supported and attached at a lower portion of a front side of the engine block 14 and can include a compressor pulley 28 that is fixed to an end of a drive shaft 30 of the compressor 26. The compressor pulley 28 is rotatably connected to the crankshaft pulley 24 by an endless belt 32. The belt 32 can transfer rotational forces between the compressor pulley 28 and the crankshaft pulley 24. The endless belt 32 also rotatably connects the crankshaft pulley 24 to an alternator pulley 38 provided on an alternator 40 connected to the engine block 14 above the compressor 26.

Figure 2:
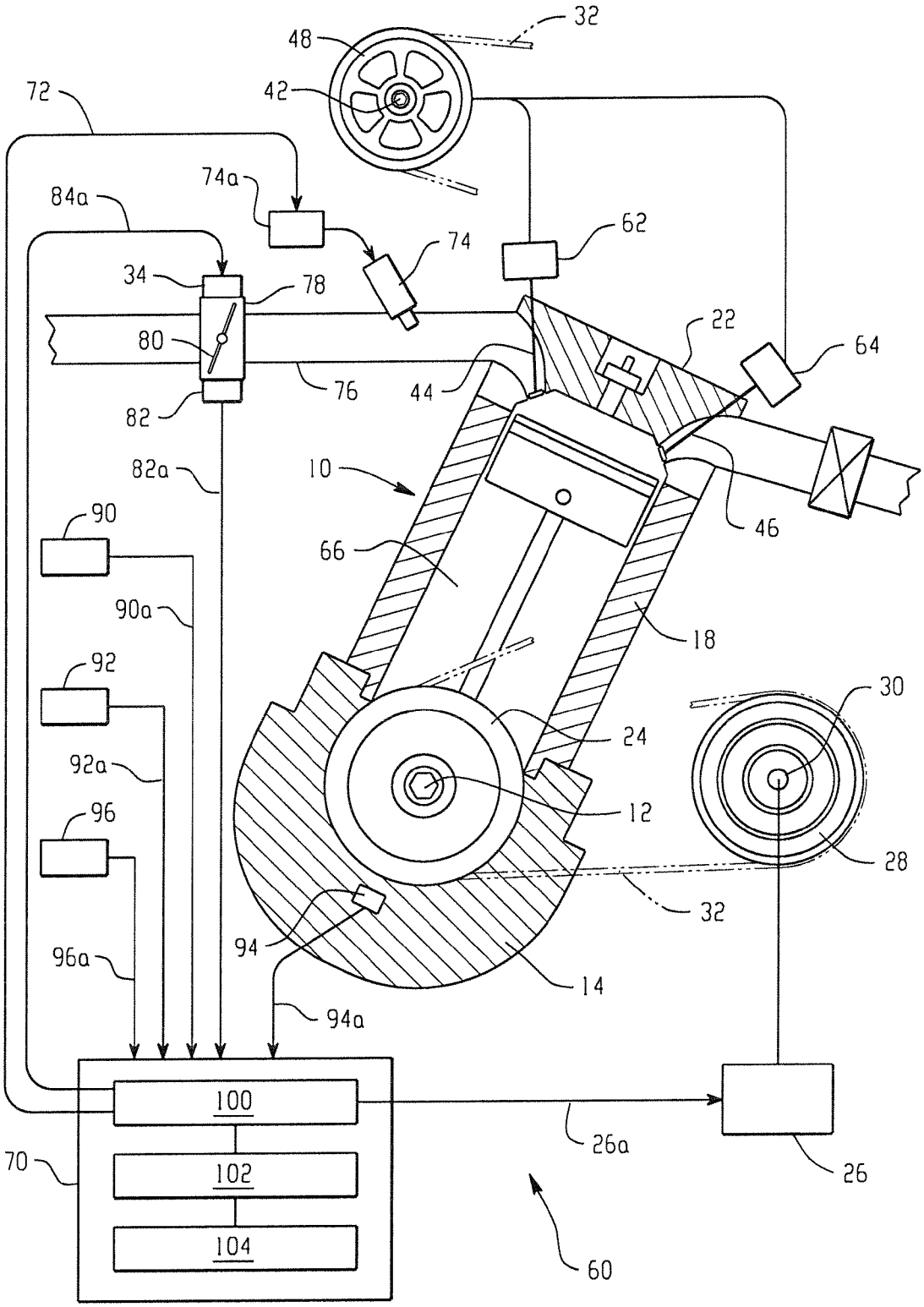
FIG. 2 is a schematic view of an engine control system for stopping an internal combustion engine, such as the engine of FIG. 1, at a desired engine stopping position.

As is known and understood by those skilled in the art, with additional reference to FIG. 2, a camshaft, such as illustrated camshaft 42, can be operatively connected to the engine 10, and particularly the crankshaft 12 thereof, for opening and closing intake and exhaust valves 44, 46 of the engine 10. The camshaft 42 can include a camshaft pulley 48 secured at one end thereof that is rotatably connected to the crankshaft pulley 24 by the endless belt 32 (i.e., the pulleys 44 and 24 are connected to one another by the belt 32). Additional pulleys, such as idler pulley 50 and tensioner pulley 52, can also be rotatably connected to the crankshaft pulley 24 via the endless belt 32. Although not shown, it is to be appreciated that rotational connection between the camshaft 42 and the crankshaft 26 can be configured other than what is shown in the illustrated embodiment (e.g., the camshaft pulley 48 could be connected to the crankshaft 12 and/or the crankshaft pulley 24 by a separate belt).

In FIG. 2, an engine control system 60 is illustrated for stopping the engine 10 at a desired engine stopping position. In the control system 60, as already described, the air conditioner compressor 46, and particularly the pulley 28 thereof, is rotatably connected to the crankshaft pulley 24 by the belt 32 and is capable of generating a counter torque to the engine 10 when the compressor 26 is actuated. As is known and understood by those skilled in the art, rotatable coupling of the camshaft pulley 48 to the crankshaft 24 via the endless belt 32 results in rotation of the camshaft 42 when the crankshaft 12 is rotated. Disposed on the crankshaft 42 but not shown are one or more cams which selectively operate schematically illustrated rocker arms 62, 64 for opening and closing the intake and exhaust valves 44, 46. This regulates the supply of feed gas and expulsion of exhaust gas from the cylinders (only one cylinder 66 shown) of the engine 10. In particular, the valves 44, 46 are normally maintained in respective closed positions by respectively biasing mechanisms (not shown), such as valve springs, and are opened against the urging of the springs by the rocker arms 62, 64, which are themselves pivoted or otherwise moved by the cams of the camshaft 42, to impart linear movement, such as opening movement, to the intake and exhaust valves 44, 46.

The engine control system 60 can include an electronic control unit (ECU) 70 operatively linked to the engine 10 for control thereof. For example, fuel delivery to the engine 10 can be controlled by the ECU 70. In particular, the ECU 70 can send a command signal or signals 72, which cause fuel injectors 74 (only one shown) to cut or cease delivery of fuel to the engine 10. More particularly, in one exemplary embodiment, the ECU 70 directs an injector driver 74 to vary output voltage that normally drives the fuel injector 74 and thereby cuts fuel to the engine 10 as appropriate.

Intake manifold 76 is operatively connected to the engine 10 for delivery of combustion air thereto. A throttle or throttle body 78 is provided upstream of the intake manifold 76 for controlling airflow delivered to the engine 10. A throttle valve 80 can be rotatably disposed within the throttle body 78 for regulating air flow into the engine 10 as the throttle valve 80 is angularly moved. A degree of opening of the throttle valve 80 can be sensed by throttle valve opening sensor 82 and communicated as a signal 82*a* indicative of the sensed throttle valve amount (THA) to the ECU 70 via a link therewith. The throttle bottle controller 84 is linked to the ECU 70 for receiving an open command signal 84*a* from the ECU 70. The throttle body controller 84 is configured to move the throttle valve 80 to a desired position based on the command signal 84*a* received from the ECU 70. As used herein, a link or being linked is being used broadly to cover any operative connection between components of the system 10 whether wired or wireless that enables the linked components to communicate (e.g., transmit a signal from one component to another).

The ECU 70 can also be operatively connected to the compressor 26. In particular, the ECU 70 can send a command signal 26*a* to the compressor 26 for actuating the compressor, which thereby generates a counter torque to the engine 10. This, as will be described in further detail below, can be used to stop the engine at a desired stopping position.

The system 60 can additionally employ one or more sensors for sensing various operating conditions of the engine 10, or components associated therewith, and communicating the sensed conditions as signals to the ECU 70. For example, an engine speed sensor 90, which can indicate an engine speed of the engine 10, can be linked to the ECU 70 so that the measured engine speed (NE) can be communicated as a signal 90*a* indicative of the engine speed. An engine temperature sensor 92 can be linked to the ECU 70 so that the measured engine temperature (TW) can be communicated as signal 92*a* indicative of the engine temperature back to the ECU 70. A rotational position sensor 94 can be provided for indicating an engine rotational position, such as an engine rotational position of the crankshaft 12 and/or the crankshaft pulley 24. The rotational position sensor 94 can be linked to the ECU 70 so that the engine rotational position (e.g., of the crankshaft 12 and/or the crankshaft pulley 24) can be communicated as signal 9*a* indicative of the engine rotational position back to the ECU 70. Through such links, the ECU 70 is operatively connected to each of the engine speed sensor 90, the engine temperature sensor 92 and the rotational position sensor 94.

The control system 60 can additionally include at least one device which can be operatively connected to the ECU 70 for indicating that the engine 10 is off. The at least one device for indicating that the engine 10 is off can be an ignition switch that is operatively connected to the ECU 70. The ignition switch 96, in one embodiment, has an off position or state that indicates that the engine 10 is off. The ignition switch 96 can be linked to the ECU 70 so that the indication that the ignition switch 96 is in its off position or state can be communicated as signal 96*a* indicating that the engine 10 is off to the ECU 70. In addition, or in the alternative, the at least one device for indicating that the engine 10 is off can be the throttle position sensor 82 that is operatively connected to the ECU 70 for indicating to the ECU 70 the angular position of the throttle or throttle valve 80. In particular, the throttle valve 80 can be associated with a particular position that indicates that the engine 10 is off. When the throttle position sensor 82 indicates via signal 82*a* that the throttle valve 80 is in this position, the ECU 70 can be informed that the engine 10 is off.

The ECU 70 can include an input/output interface 100 for sending and receiving signals with the various components of the system 10, including controllers (e.g., throttle controller 84), sensors (e.g., throttle valve opening sensors 82, engine speed sensor 90, engine temperature sensor 92, engine rotational position sensor 94, etc.), the fuel injectors 74 or injector drivers 74A, the ignition switch 96, the compressor 26, etc. Although not illustrated, the input/output interface 100 can include an input circuit having various functions including the function of shaping the wave forms of input signals from the various sensors or other components, a function of correcting the voltage of the input signals to a predetermined level, and a function of converting analog signal values into digital signal values. The input/output interface 100 can also include an output circuit for supplying drive signals to the various components of the system, such as the fuel injection valves 74, the driver 74*a* therefore, the compressor 26, the throttle controller 84, etc. The ECU 70 can additionally include a central processing unit (CPU) 102 linked to the input/output interface 100 and linked to a memory or memory circuit 104 including a ROM, which can preliminarily store various operational programs to be executed by the CPU 102, and a RAM for storing the results of computations or the like by the CPU 102.

The ECU 70, and particularly the memory 104 thereof, can include a predetermined engine speed for use in stopping the engine 10 at a desired stopping position. Accordingly, this predetermined engine speed can be stored in the memory 104 of the ECU 70. As will be described in more detail below, this predetermined engine speed can correspond to an engine speed where engine torque of the engine 10 is less than a known counter torque that can be generated by the compressor 26 when actuated. Similarly, predetermined limits between which it is desirable to stop the engine can also be stored in the memory 104 of the ECU 70. In particular, these limits can correspond to an angular range located adjacent top dead center of the engine. This range can be specifically selected as a range wherein application of the counter torque by the compressor 26 is most likely to stop the engine 10 at or close to a desired stopping position.

Figure 3:
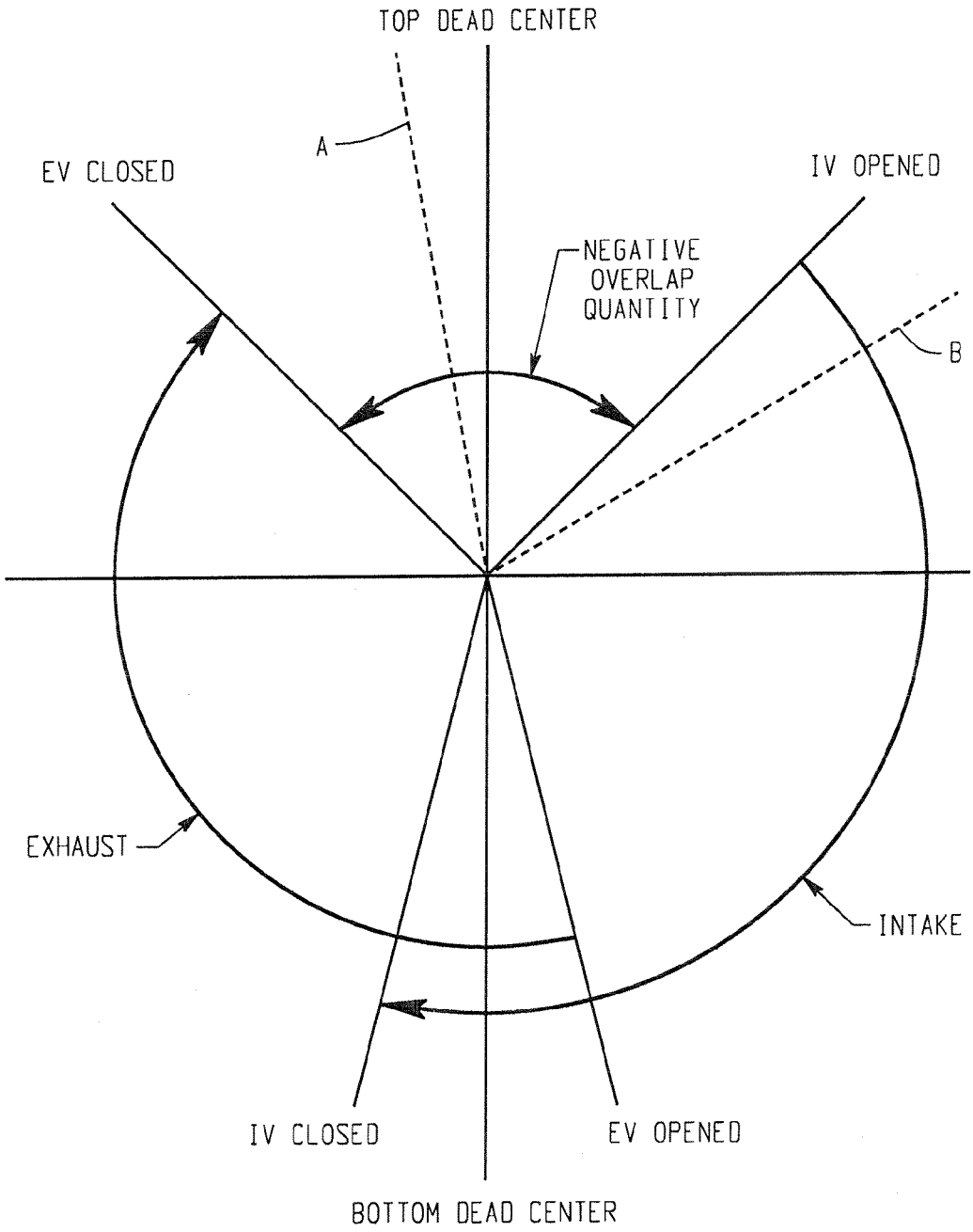
FIG. 3 is a valve timing diagram.

In one embodiment, with additional reference to FIG. 3, the predetermined limits include a lower limit A having a top dead center angle of approximately 95 degrees and an upper limit B having a top dead center angle of approximately 25 degrees. This can also be referred to as a predetermined range in which the top dead center angle is less than or equal to approximately 95 degrees and greater than or equal to approximately 25 degrees. These limits and/or this range can be selected to desirably stop the engine 10 and particularly the camshaft 42 in a position where there is no open overlap between the intake and exhaust valves 44, 46 when the engine rotational position is within the predetermined limits or range of top dead center. Additionally, the likely engine stopping position can be close to a position where the intake valve 44 is just about to open or has just opened.

In operation, the ECU 70 can actuate the compressor 26 when the engine is turned off, engine speed of the engine 10 is less than a predetermined engine speed, and the crankshaft pulley 24 is within a predetermined range of top dead center for the engine 10. More specifically, the ECU 70 can actuate the compressor 26 to generate the counter torque of the compressor 26. This counter torque can be transmitted from the compressor pulley 28 through the belt 32 to the crankshaft pulley 24 and thereby to the crankshaft 12. The ECU 70 actuating the compressor can generate sufficient counter torque to stop the engine 10 at the desired engine stopping position when the at least one device (e.g., ignition switch 96 and/or throttle position sensor 82) indicates that the engine 10 is off. The engine speed sensor 90 indicates that the engine speed is less than a predetermined engine speed stored in the memory 102 of the ECU 70, and the rotational position sensor 94 indicates that the engine rotational position is within the predetermined limits of top dead center. Again, the predetermined engine speed and the predetermined limits can be stored in the memory 104 of the ECU 70.

Figure 4:
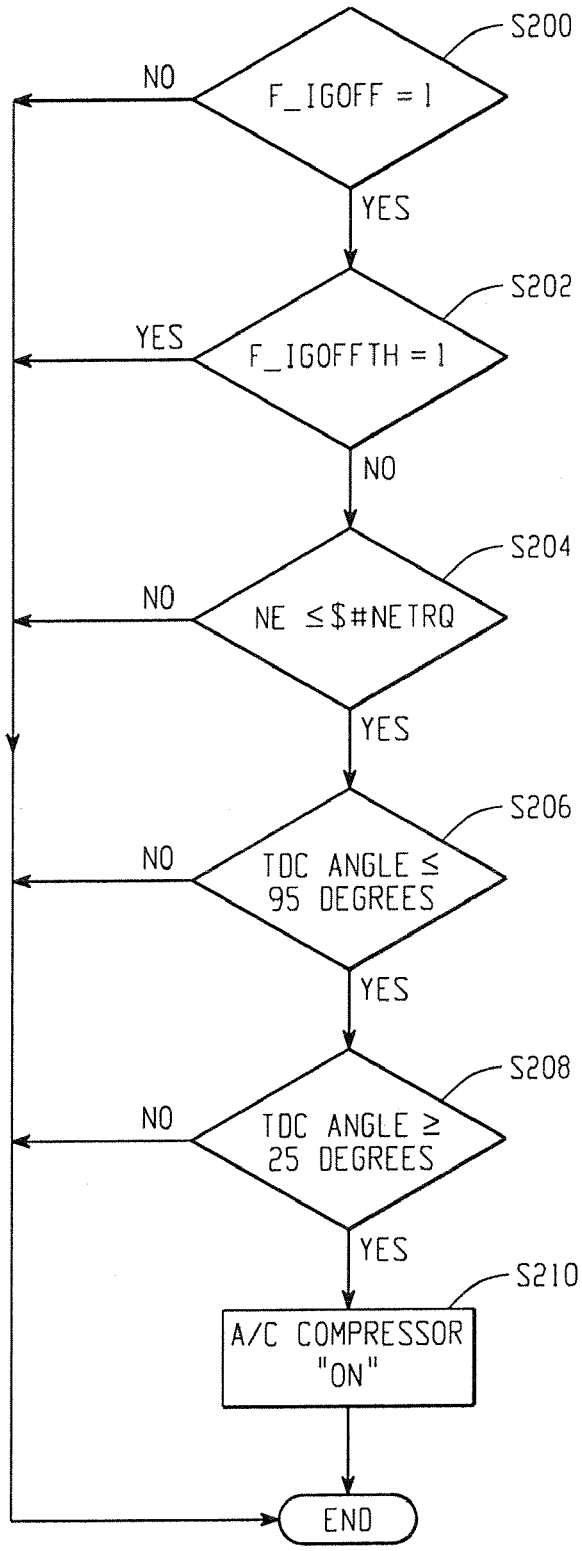
FIG. 4 is a process flow diagram illustrating an engine control method for stopping an internal combustion engine at a desired engine stopping position.

With reference to FIG. 4, an engine control method is shown according to one exemplary embodiment for stopping an internal combustion engine at a desired engine stopping position. The method illustrated in FIG. 4 will be described with particular reference to the engine control system 60 depicted in FIG. 2, though it is to be appreciated that the control method could be applied to other control systems and need not be specifically applied to the engine 10 of FIGS. 1 and 2. In the method, the internal combustion engine 10 is first determined to be off. In the illustrated method, this occurs in S200 and S202. More particularly, in S200, determining that the engine 10 is off includes the ECU 70 receiving signal 96*a* indicating that the ignition 96 associated with the engine 10 is off. In S102, determining that the engine 10 is off includes the ECU 70 receiving signal 82*a* indicating that the throttle valve 80 has been moved to a position corresponding to an off condition of the engine 10. In the illustrated method, if either the signal 96*a* from the ignition switch 96 indicates that the engine 10 is not off or the throttle valve position sensor signal 82*a* indicates that the engine 10 is not off, the method ends. However, provided the ignition switch 96 is off in S100 and the throttle is not determined to be on in S202, the method proceeds to S204.

In S204, it is determined whether the engine speed of the internal combustion engine 10 is below a predetermined engine speed. As already described herein, this can include engine speed sensor 90 relaying a measured engine speed via signal 90*a* to the ECU 70. The ECU 70 can compare the measured engine speed from the engine speed sensor 90 to a predetermined engine speed stored in memory 104. If the engine speed measured by the sensor 90 is not below the predetermined value, the method ends; otherwise the method proceeds to S206. In one embodiment, the predetermined engine speed stored in memory 104 corresponds to an engine torque that is less than a counter torque of the air conditioner compressor 26, which is operatively connected to the engine 10, particularly to the crankshaft 12 of the engine 10. Specifically, as already described herein, the endless belt 32 can transmit rotational forces between the compressor pulley 28 of the compressor 26 and the crankshaft pulley 24 of the crankshaft 12.

In S206 and S208, the engine rotational position is determined to be within the predetermined limits. In particular, as already described herein, the engine rotational position as measured by sensor 94 can be communicated to the ECU 70 via signal 94*a*. The predetermined limits can be set so that an angular range is located adjacent top dead center for the engine 10. In particular, in one embodiment, the predetermined limits include the lower limit having a top dead center angle of approximately 95 degrees and the upper limit having a top dead center angle of approximately 25 degrees. These limits can be stored in the memory 104 and the ECU 70 can compare the measured rotational position from the sensor 94 to these predetermined limits. Provided the measured rotational position is determined to be less than or equal to 95 degrees in S206 and greater than or equal to 25 degrees in S208, the method proceeds to S210; otherwise the method ends.

In S210, the air conditioner compressor 26 is turned on to stop the engine 10 at the desired engine stopping position, or closely adjacent thereto, when determined that the engine is off in S200 and S202, the engine speed is below the predetermined engine speed in S204 and the engine rotational position is within the predetermined limits as determined in S206 and S208. As already discussed herein above, the engine rotational position being within the predetermined limits can correspond to a camshaft rotational position wherein there is no open overlap between one or more intake valves 44 of the engine 10 and one or more exhaust valves 46 of the engine 10 to prevent exhaust gases from traveling into the intake manifold 76 of the engine 10.

It will be appreciated that various of the above-disclosed and other features and functions, or alternatives or varieties thereof, may be desirably combined into many other different systems or applications. For example, it should be appreciated that the exact upper and lower limits may not be exactly those describe in reference to the illustrated embodiment and may vary for different engine configurations. Also that various presently unforeseen or unanticipated alternatives, modifications, variations or improvements therein may be subsequently made by those skilled in the art which are also intended to be encompassed by the following claims.

The invention claimed is:

1. An engine control system for stopping an internal combustion engine at a desired engine stopping position, comprising:

an air conditioner compressor operatively connected to the engine that generates a counter torque to the engine when actuated;

at least one device for determining that the engine is off;

an engine speed sensor for sensing an engine speed of the engine;

a rotational position sensor for that sensing an engine rotational position; and an ECU operatively connected to the compressor, the at least one device for determining that the engine is off, the engine speed sensor for sensing an engine speed of the engine and the rotational position sensor for sensing an engine rotational position, the ECU actuating the compressor to generate the counter torque to stop the engine at the desired engine stopping position when the at least one device determines that the engine is off, the engine speed sensor senses and communicates that the engine speed is less than a predetermined engine speed, and the rotational position sensor senses and communicates that the engine rotational position is within predetermined limits of top dead center.

2. The engine control system of claim 1 wherein the air conditioner compressor includes a compressor pulley that is rotatably connected to a crankshaft pulley of the engine by a belt, the belt transferring rotational forces between the compressor pulley and the crankshaft pulley.

3. The engine control system of claim 1 wherein the at least one device is an ignition switch operatively connected to the ECU, the ignition switch having an off position or state that corresponds to the engine being off.

4. The engine control system of claim 1 wherein the at least one device is a throttle position sensor operatively connected to the ECU for communicating to the ECU an angular position of the throttle.

5. The engine control system of claim 1 wherein the predetermined engine speed is stored in a memory of the ECU and corresponds to an engine speed where engine torque is less than the counter torque.

6. The engine control system of claim 1 wherein the predetermined limits are stored in a memory of the ECU and the limits correspond to an angular range located adjacent top dead center of the engine.

7. The engine control system of claim 6 wherein the predetermined limits include a lower limit having a top dead center angle of approximately 95 degrees and an upper limit having a top dead center angle of approximately 25 degrees.

8. The engine control system of claim 1 further including:

a camshaft operatively connected to the engine for opening and closing intake and exhaust valves of the engine, the camshaft in a position where there is no open overlap between the intake and exhaust valves when the engine rotational position is within the predetermined limits of top dead center.

9. The engine control system of claim 8 wherein the camshaft includes a camshaft pulley, the compressor includes a compressor pulley and the engine includes a crankshaft pulley, the pulleys rotatably connected to one another by a belt.

10. An engine control method for stopping an internal combustion engine at a desired engine stopping position, comprising:

determining that the internal combustion engine is off;

determining that an engine speed of the internal combustion engine is below a predetermined engine speed;

determining than an engine rotational position is within predetermined limits; and turning on an air conditioner compressor to stop the engine at the desired engine stopping position when determined that the engine is off, the engine speed is below the predetermined engine speed, and the engine rotational position is within the predetermined limits.

11. The method of claim 10 wherein the predetermined limits are an angular range located adjacent top dead center.

12. The method of claim 10 wherein the predetermined limits include a lower limit having a top dead center angle of approximately 95 degrees and an upper limit having a top dead center angle of approximately 25 degrees.

13. The method of claim 10 wherein determining that the engine is off includes an ECU receiving a signal indicating that an ignition associated with the engine is off.

14. The method of claim 10 wherein determining that the engine is off includes an ECU receiving a signal indicating that a throttle valve has been moved to a position corresponding to an off condition of the engine.

15. The method of claim 10 wherein the predetermined engine speed corresponds to an engine torque that is less than a counter torque of an air conditioner compressor operatively connected to the engine.

16. The method of claim 15 wherein the internal combustion engine includes a crankshaft pulley and the air conditioner compressor includes a compressor pulley, and wherein the compressor being operatively connected to the compressor includes a belt transmitting rotational forces between the crankshaft pulley and the compressor pulley.

17. The method of claim 10 wherein the engine rotational position being within predetermined limits corresponds to a camshaft rotational position wherein there is no open overlap between one or more intake valves of the engine and one or more exhaust valves of the engine to prevent exhaust gasses from traveling into an intake manifold of the engine.

18. An engine control system, comprising:

an engine having a crankshaft pulley;

an air conditioner compressor having a compressor pulley rotatably connected to the crankshaft pulley by a belt; and an ECU operatively connected to the compressor, the ECU actuating the compressor when the engine is turned off, engine speed of the engine is less than a predetermined engine speed, and the crankshaft pulley is within a predetermined range of top dead center for the engine.

19. The engine control system of claim 18 further including:

at least one device for indicating that the engine is off;

an engine speed sensor for indicating an engine speed of the engine; and a rotational position sensor for indicating that the engine rotational position.

20. The engine control system of claim 18 wherein the predetermined range is a top dead center angle less than or equal to approximately 95 degrees and greater than or equal to approximately 25 degrees.

* * * * *

UNITED STATES PATENT AND TRADEMARK OFFICE

CERTIFICATE OF CORRECTION

PATENT NO. : 8,375,912 B2
APPLICATION NO. : 12/764228
DATED : February 19, 2013
INVENTOR(S) : Stanley D. Lent It is certified that error appears in the above-identified patent and that said Letters Patent is hereby corrected as shown below:

ON THE TITLE PAGE:

Item (75) Inventor, should read: Stanley D. Lent, Marysville, OH (US)

Signed and Sealed this
Twenty-eighth Day of May, 2013

Teresa Stanek Rea
*Acting Director of the United States Patent and Trademark Office*